US011969093B2

(12) United States Patent
Bangalore

(10) Patent No.: US 11,969,093 B2
(45) Date of Patent: Apr. 30, 2024

(54) MODULAR CHAIR

(71) Applicant: Venkataramu Bangalore, Plano, TX (US)

(72) Inventor: Venkataramu Bangalore, Plano, TX (US)

(73) Assignee: NOBLE HOUSE HOME FURNISHINGS, LLC, Chatsworth, CA (US)

( * ) Notice: Subject to any disclaimer, the term of this patent is extended or adjusted under 35 U.S.C. 154(b) by 0 days.

(21) Appl. No.: 17/831,966

(22) Filed: Jun. 3, 2022

(65) Prior Publication Data

US 2022/0361673 A1 Nov. 17, 2022

Related U.S. Application Data

(63) Continuation of application No. 17/018,942, filed on Sep. 11, 2020, now Pat. No. 11,350,749.

(Continued)

(51) Int. Cl.

| | |
|---|---|
| ***A47C 1/024*** | (2006.01) |
| ***A47C 1/14*** | (2006.01) |
| ***A47C 4/02*** | (2006.01) |
| ***A47C 4/04*** | (2006.01) |
| ***A47C 4/08*** | (2006.01) |
| ***A47C 7/50*** | (2006.01) |
| ***A47C 7/54*** | (2006.01) |
| ***A47C 13/00*** | (2006.01) |

(52) U.S. Cl.

CPC ..... *A47C 1/024* (2013.01); *A47C 4/02* (2013.01); *A47C 7/5066* (2018.08)

(58) Field of Classification Search

CPC ..... A47C 1/024; A47C 7/5066; A47C 4/02

USPC ..... 297/17, 31, 118, 411.4, 411.41, 411.42, 297/451.8, 440.23, 357

See application file for complete search history.

(56) References Cited

U.S. PATENT DOCUMENTS 2,104,666 A * 1/1938 Molnar ..... A47C 17/165 297/118

2,464,995 A * 3/1949 Roth ..... A47C 5/04 297/411.42

(Continued)

FOREIGN PATENT DOCUMENTS

DE 202012008926 U1 * 12/2012 ..... A47C 1/0246

FR 708968 A * 9/1931 ..... A47C 7/5086

(Continued)

*Primary Examiner* — Rodney B White

(74) *Attorney, Agent, or Firm* — Colin P. Abrahams

(57) ABSTRACT

A modular furniture seat assembly comprises a seating portion having a front end, a rear end, a pair of opposing side edges, and a seating connector component on each of the opposing side edges. A back portion is provided and has a lower end, an upper end, and a pair of opposing side edges. The lower end of the back portion connects to the rear end of the seating portion. A pair of lateral support arm assemblies is provided, each having an inner surface and an outer surface, with each of the pair of lateral support arm assemblies having a first arm connector component which is releasably connectable to the seating connector component. The lateral support arm assemblies comprise an armrest portion and a leg portion, with the leg portion supporting the modular furniture seating item when it is an assembled condition.

14 Claims, 4 Drawing Sheets

Related U.S. Application Data

(60) Provisional application No. 62/900,340, filed on Sep. 13, 2019.

(56) References Cited

U.S. PATENT DOCUMENTS

D165,058 S * 11/1951 Deutsch ..... 297/411.42
D167,491 S * 8/1952 Witty ..... 297/411.42
D177,092 S * 3/1956 Grossberg ..... 297/411.42
D180,032 S * 4/1957 Pearlstine ..... 297/411.42
3,179,465 A * 4/1965 Roberts ..... A47C 4/52
297/17 X
3,233,942 A * 2/1966 Creutz ..... A47B 85/00
297/118
3,301,597 A * 1/1967 Bereday ..... A47C 4/028
297/440.23
4,124,251 A * 11/1978 Petersen ..... A47C 4/02
297/440.23 X
4,209,198 A * 6/1980 Apple, Sr. ..... A47C 4/02
297/440.23 X
4,302,048 A * 11/1981 Yount ..... A47C 4/02
297/440.1
4,389,070 A * 6/1983 Chien ..... A47C 7/506
297/423.26
4,579,383 A * 4/1986 Colby ..... A47C 4/283
297/440.23 X
4,740,033 A * 4/1988 Lee ..... A47C 4/02
297/118 X
4,742,900 A * 5/1988 Boxhammer ..... A47C 17/82
297/17 X
4,919,485 A * 4/1990 Guichon ..... A47C 4/02
297/440.23 X
4,921,301 A * 5/1990 Haynes ..... A47C 1/143
297/118
5,224,760 A * 7/1993 Gibbs ..... A47C 4/02
297/448.1
5,507,563 A * 4/1996 Arthur, Jr. ..... A47C 4/02
297/440.23 X
6,422,654 B1 * 7/2002 Grove ..... A47C 7/42
297/440.23 X
7,775,590 B2 * 8/2010 Shen ..... A47C 4/02
297/411.42
8,123,291 B1 * 2/2012 Hernandez ..... A47C 1/143
297/31 X
8,646,843 B2 * 2/2014 Koch ..... A47C 4/028
297/440.23 X
8,733,836 B2 * 5/2014 Gross ..... A47C 31/11
297/229
9,185,982 B2 * 11/2015 Kilzer ..... A47C 1/024
10,383,450 B2 * 8/2019 Iles ..... A47C 1/143
10,426,272 B2 * 10/2019 Iles ..... A47C 15/006
10,980,347 B1 * 4/2021 Levin ..... A47C 4/02
11,350,749 B2 * 6/2022 Bangalore ..... A47C 1/024
2009/0224496 A1 * 9/2009 Watts ..... A47C 3/18
297/17 X
2011/0089739 A1 * 4/2011 Huang ..... A47C 4/03
297/440.23 X
2018/0220801 A1 * 8/2018 Hoffmann ..... A47C 7/66
2019/0104855 A1 * 4/2019 Iles ..... A47C 7/5066
2019/0104856 A1 * 4/2019 Iles ..... A47C 4/02

FOREIGN PATENT DOCUMENTS

FR 1039393 A * 10/1953 ..... A47C 1/024
GB 485262 A * 5/1938 ..... A47C 7/5086
GB 485263 A * 5/1938 ..... A47C 1/028
GB 786575 A * 11/1957 ..... A47C 7/5086
KR 2018001413 U * 5/2018 ..... A47C 1/024

* cited by examiner

MODULAR CHAIR

CROSS REFERENCE TO RELATED APPLICATIONS

This application is a continuation application of U.S. patent application Ser. No. 17/018,942 filed Sep. 11, 2020, now U.S. Pat. No. 11,350,749 B2, which claims the benefit of United States Provisional Patent Application No. 62/900,340 filed Sep. 13, 2019, the contents of both of which are incorporated herein by reference in their entireties.

FIELD AND BACKGROUND OF THE INVENTION

This invention relates to a modular chair. The chair of the invention may come in several different forms, such as a chaise lounge, an indoor chair, a chair adapted or intended for use as garden furniture, or a chair which may be configured for use on the beach. These are examples only, and any chair having the features and structure as described is intended to fall within the scope of the invention.

In the current market relating to availability of chair furniture, a beach chair is typically exclusively used at beach locations, and will be placed on beach sand. Correspondingly, there are also chairs having uses as garden furniture or as swimming pool lounges, and will most usually be configured so as to be used in specific areas. Such chairs may either be manufactured as a more or less conventional seat with the backrest, or as a stretch seat which may typically include a component providing a surface or platform structure for accommodating fully or partially the legs and feet.

SUMMARY OF THE INVENTION

According to one aspect of the invention, there is provided a modular furniture seat assembly comprising: a seating portion having a front end, a rear end, a pair of opposing side edges, and a seating connector component at or near each of the opposing side edges; a back portion having a lower end, an upper end, and a pair of opposing side edges, wherein the lower end of the back portion connects to the rear end of the seating portion; and a pair of lateral support arm assemblies having an inner surface and an outer surface, each of the pair of lateral support arm assemblies having a first arm connector component which is releasably connectable to the seating connector component, the lateral support arm assemblies comprising an armrest portion and at least one a leg portion, the leg portion supporting the modular furniture seating item when it is an assembled condition.

The modular furniture seat assembly may further comprise a pivot member for connecting the lower end of the back portion to rear end of the seating portion such that back portion is pivotally movable relative to the seating portion about the pivot member between a substantially horizontal position in which the seating portion and the back portion are generally co-planar and a substantially vertical position in which the back portion is generally in an upright or vertical position. The pivot member is preferably a releasable pivot member which allows the seating portion and the back portion to the selectively assembled and disassembled about the releasable pivot member.

In one embodiment, an extender frame extends outwardly away from the rear end of the seating portion, supporting at least in part the back portion when the back portion is in the substantially horizontal position. The extender frame may be selectively removable from the seating portion. Preferably, the extender frame is movable between a folded position in which it is folded against the seating portion and an unfolded position in which the extender frame is in the extended position for supporting the back portion. Further, the extender frame may have an extender frame connector component and the lateral support arm has a second arm connector component, the extender frame connector component connecting to the second arm connector component of the lateral support arm.

In a further embodiment, a support bracket is positioned between the extender frame and the back portion to support the back portion, the support bracket being movable between a plurality of selected positions to support the back portion in an orientation and at an angle relative to the seating portion. The support bracket may be pivotally fixed at one end to the back portion so that it can be moved to a storage position against the back portion when not required for supporting the back portion. Further, the extender frame may have a plurality of spaced lock members for receiving an end of the support bracket, such that the back portion is differently angled relative to the seating portion depending upon the lock member which receives the end of the support bracket.

In yet a further embodiment, a foot portion is provided having a front end and a remote end, the front end of the foot portion connecting to the front end of the seating portion in a releasable manner and such that the foot portion can be rotated relative to the seating portion to selectively adjust the orientation thereof relative to the seating portion. There may be a foot portion support leg foldable between a stowaway position against the foot portion and an extended position wherein it provides support to the foot portion at or near its remote end.

Preferably, the seating portion, back portion and lateral support arm assemblies may be disassembled and compactly placed in a customized container for storage and transportation.

In one form, the support arm assembly further comprises a second arm connector component, and the seating portion further comprises an additional seating connector component connectable to the second arm connector component. The leg portions of the lateral support arm assembly may have leg ends which are configured to keep the furniture seat assembly stable on different types and smoothness surfaces.

In one embodiment, each lateral arm support comprises a generally linear front portion having a leg end and an upper end, and curved rear portion having a leg end and an upper end, the upper ends of the front portion and the curved portion respectively being attached to each other, wherein the first arm connector component is located on the linear front portion of the lateral arm support. A second arm connector component may be located on the curved rear portion of the lateral arm support and a second seating connector component on the seating portion, the second arm connector component connecting with the second seating connector component when the furniture seat assembly is in the assembled form.

According to a further aspect of the invention, there is provided a method of constructing a modular furniture seat assembly comprising: providing a seating portion having a front end, a rear end, a pair of opposing side edges, and a seating connector component on each of the opposing side edges; providing a back portion having a lower end, an upper end, and a pair of opposing side edges, and connecting the lower end of the back portion connects to the rear end of the seating portion; and securing a pair of lateral support arm assemblies to the seating portion, the lateral support arm assemblies having an inner surface and an outer surface, connecting each of the pair of lateral support arm assemblies having a first arm connector component releasably to the seating connector component, the lateral support arm assemblies forming an armrest portion adjacent the seating portion and a leg portion supporting the modular furniture seating item on a surface when it is an assembled condition.

An extender frame may be added to the front end of the seating portion and extending away therefrom to provide additional support for the back portion. Further, a second arm connector may be added to the lateral support arm assembly and a second seating connector to the seating portion or the extender frame, and connecting to each other the second arm connector and the second seating connector.

The modular chair of the invention may therefore take different forms and be configured for different situations or applications, and comprises a number of components which can be assembled and disassembled so that the modular chair of the invention can be easily transported or stored, assembled where needed, and disassembled once more. In one embodiment, the modular chair of the invention is a recliner, offering a seating area, a back area fastened to the seating area which can preferably be placed in different selected angular positions to suit the needs of the user, and a foot or leg area also fastened to the seating area at a position opposite that of the back area, the foot or leg area also preferably having a plurality of angular positions to suit the user. Further, the reclining modular chair of the invention may also comprise a handle or a pair of handles. In one embodiment, one handle may be located on each side of the chair, with the handles being not only removable in one embodiment of the invention, but also adapted to have or incorporate legs which support the modular chair, in a manner which would facilitate the positioning of the chair on multiple different types of surfaces, thereby making the chair more versatile and of wider utility.

According to one aspect of the invention, there is provided a knockdown modular chair, preferably but not necessarily in the form of a recliner, having a centrally located seating portion having opposing side ends, a front-end, and a rear end, a back rest having side ends, a bottom end, and a top end, the bottom end of the backrest being adjustably and releasably connectable at or near the rear end of the seating portion, and a foot rest having side ends, a bottom end, and a top end, the top end of the foot rest being adjustably and releasably connected at or near the front end of the seating portion.

In accordance with a further aspect of the invention, there is provided a first side handle and a second side handle which may be releasably connected to the side ends of the seating portion. Preferably, at least one of the first and second side handles have an upper component which extends above the seating surface of the seating portion, and a lower component which extends below the seating surface of the seating portion, and which may form legs which support the chair. At east one of the first and second side handles therefore operates and has structure which give them dual functionality. As a consequence, the modular chair of the invention may require fewer parts, have better compacting capability, and thus be easier and quicker for the user to assemble and break down.

In one form of the invention, the seating portion has a frame portion which may extend outwardly or away from the rear end of the seating portion, the frame portion in a preferred embodiment having a shape which matches the backrest, and which near fully or partially supports the all or most of the backrest when it is in a fully reclined position to keep it stable and secure. The frame portion may also comprise a support assembly which in one embodiment can be placed at various locations for supporting and holding in position the backrest in different stages of recline, selectable by the user. In another embodiment, the support assembly may comprise a support frame which can be selectively positioned between the backrest and the frame portion, with the frame portion having recesses or other structure for maintaining the support frame in the preferred position so that optimal orientation of the backrest can be achieved.

The support assembly may therefore comprise a bracket which releasably engages at multiple points with the rear surface of the backrest, and also engages at multiple points with the frame portion so that the backrest can be optimally located in a comfortable position for the user, anywhere between a generally upright position and a generally horizontal position.

DETAILED DESCRIPTION OF THE INVENTION

Figure 1:
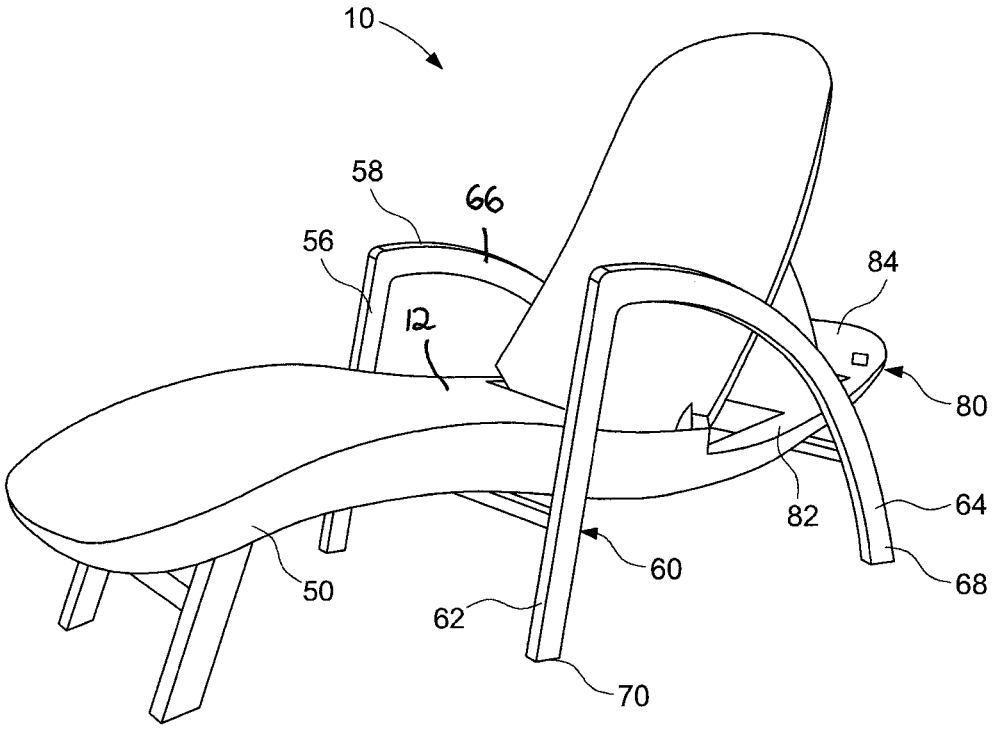
FIG. 1 is a top perspective top view of a modular chair in accordance with one aspect of the invention in its assembled condition and with a partially reclined backrest.

Reference is now made to the accompanying drawings which shows one embodiment of a modular chair constructed in accordance with the present invention. Other chairs or furniture items having the structures and the features of the modular chair described herein also fall within the scope of the invention, and the description of the present embodiment should not be interpreted as limiting the invention to this particular design or version.

In the various figures of the drawings, there is shown an assembled view (such as in FIG. 1) of the modular chair 10 of the invention, with the backrest in a generally inclined position. The modular chair 10 comprises a seating area 12 having an upper surface 14 which operates as the seating surface, a back edge 16, a front edge 18, and opposing side edges 20 and 22. The modular chair 10 further comprises a backrest 26 having an upper surface 28, a lower edge 30, a curved or rounded upper edge 32, and a pair of side edges 34 and 36. As described further below, the lower edge 30 of the backrest 26 releasably and adjustably connects to the back edge 16 of the seating area 12 in a manner which allows the backrest 26 to pivot about the connection so that it can be raised and lowered by pivoting about the connection area into the desired and selected inclined positions, ranging from substantially horizontal to approaching vertical positions.

The modular chair 10 also includes a leg support 40 having an upper surface 42 upon which a user's legs and/or feet may be fully or partially supported, a back edge 44, a rounded front edge 46, and opposing side edges 48 and 50. The back edge 44 of the leg support 40 is pivotally or otherwise connected to the front edge 18 of the seating area 12, and their relative positions may, in certain embodiments, be capable of adjustment to suit a user's choice so that an optimal or comfortable position of the leg support 40 may be selected and held in that position.

The modular chair 10 further comprises a pair of lateral handles 58 and 60. Each of the lateral handles 58 and 60 comprises a front generally linear component 62 and an arcuate component 64. Each of the lateral handles 58 and 60 further has an inner surface 66 and an outer surface 68. Both the linear component 62 and the arcuate component 64 have flat leg ends 70 for resting on the surface or substrate upon which the modular chair 10 may be located.

On the inner surface 66 of each of the lateral handles 58 and 60 there are located connectors 74 which engage with corresponding connectors 76 located on the side edges 20 and 22 of the seating area 12. These connectors 74 and 76 may take many different forms, such as a post and aperture which snap together, a post receivable within the slot, components for connection by hardware such as a bolt or pivot pin, to name a few. Preferably, however, all such connector types achieve the same purpose of fastening the lateral handles 58 and 62 to the side edges 20 and 22 of the seating area 12. Preferably, too, the form of connection is one that allows for assembly and disassembly so that the handles 58 and 60 can be removed for transportation or storage, but readily available for connection when assembly is again required. Preferably, a quick connect type fastening system works best for this purpose, creating a modular chair 10 which is easily and conveniently assembled and broken down for storage and transport.

FIG. 1 of the drawings, as mentioned, shows a top perspective view of a modular chair 10 in accordance with the invention in the assembled position. The backrest 26 is in a generally partially inclined position, although it is possible that the backrest 26 may be movable to a more vertical position than that shown in FIG. 1. Further, it may be moved to a more inclined position, selected by the user.

Figure 2:
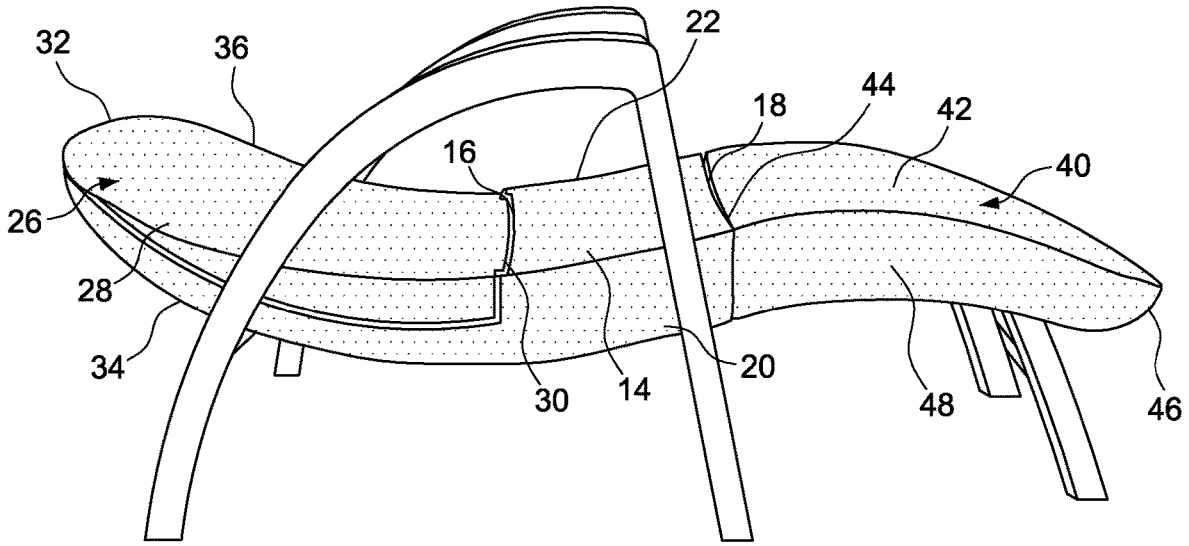
FIG. 2 is a side perspective view of the modular chair as shown in FIG. 1, shown in its assembled position with the backrest fully or near fully reclined.

FIG. 1 also shows a frame portion 80, which is an extension of the seating area 12. The frame portion 80 generally extends outwardly and away from the seating area 12. The frame portion 80 includes side supports 82 and a head support 84. It will be appreciated that the side supports 82 and the head support 84 receive and support, either fully or partially, the backrest 26 when it is moved to the reclined or near horizontal position, as shown in FIG. 2 of the drawings. Either way, it is configured to provide a stable and secure support for the backrest 26 when it is in the reclined position. FIG. 2 shows the modular chair 10 in the reclined position, and the presence of the handles 58 and 60 potentially protect a person using the chair 10 from falling off the chair 10, or from being tossed or accidentally toppled therefrom. The frame portion 80, as mentioned, provides a full support for the backrest 26 when in the fully reclined position, making the backrest particularly secure and stable when in this position. In other words, an all-around frame may be provided for the backrest 26, enhancing its stability.

In the embodiment shown, the seating area 12, backrest 26 and leg support 40 have a contoured and continuous surface, which may vary by design, to provide a comfortable seating and reclining surface for the user.

Figures 3A, 3B:
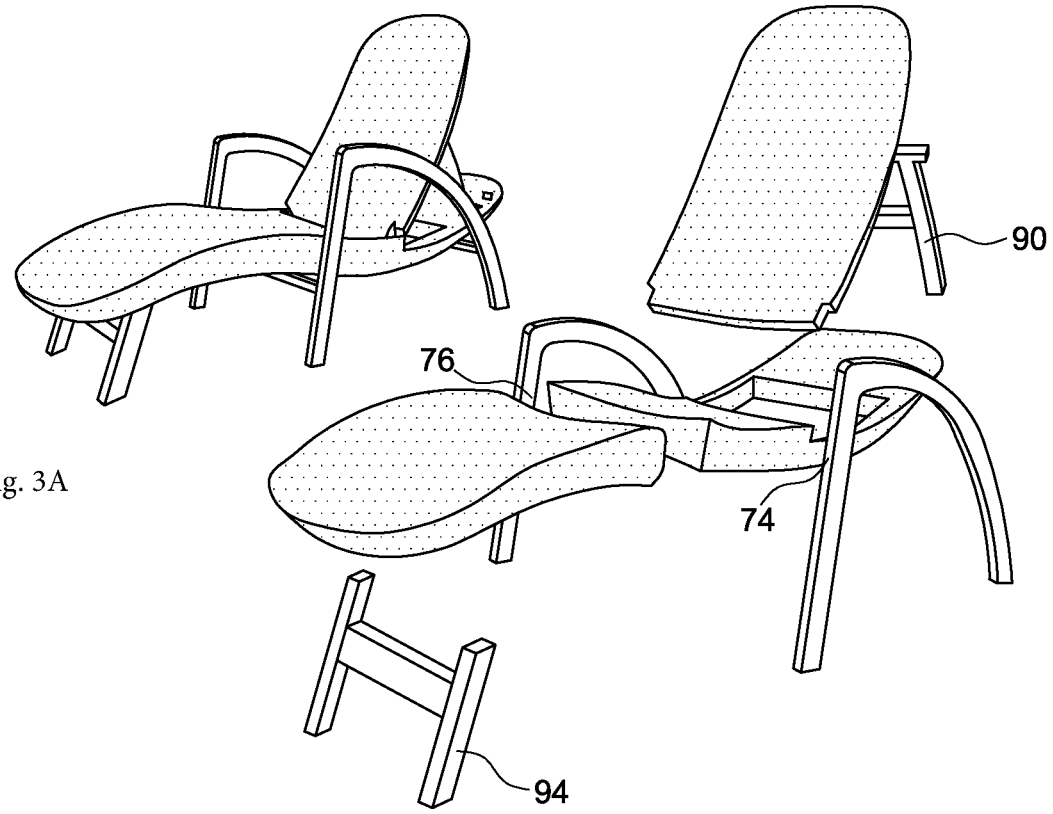
FIGS. 3A and 3B of the drawings shows a modular chair as illustrated in FIG. 1 in a fully assembled position as seen in FIG. 3A, and in an exploded view as seen in FIG. 3B, to better illustrate the various components and their relationship from similar viewpoints.

FIGS. 3A and 3B of the drawings shows the modular chair 10 in both an assembled position (FIG. 3A) and, adjacent thereto, the chair 10 is illustrated in an exploded view with the parts separated (FIG. 3B), so as to provide a better understanding of the parts. Indeed, the modular chair 10 of the invention can be disassembled and placed in a small luggage carrier or other suitable container, which may be zippered and have a carrying handle, so that it can be transported or carried conveniently from one location to another in an efficient and comfortable manner.

Figure 4:
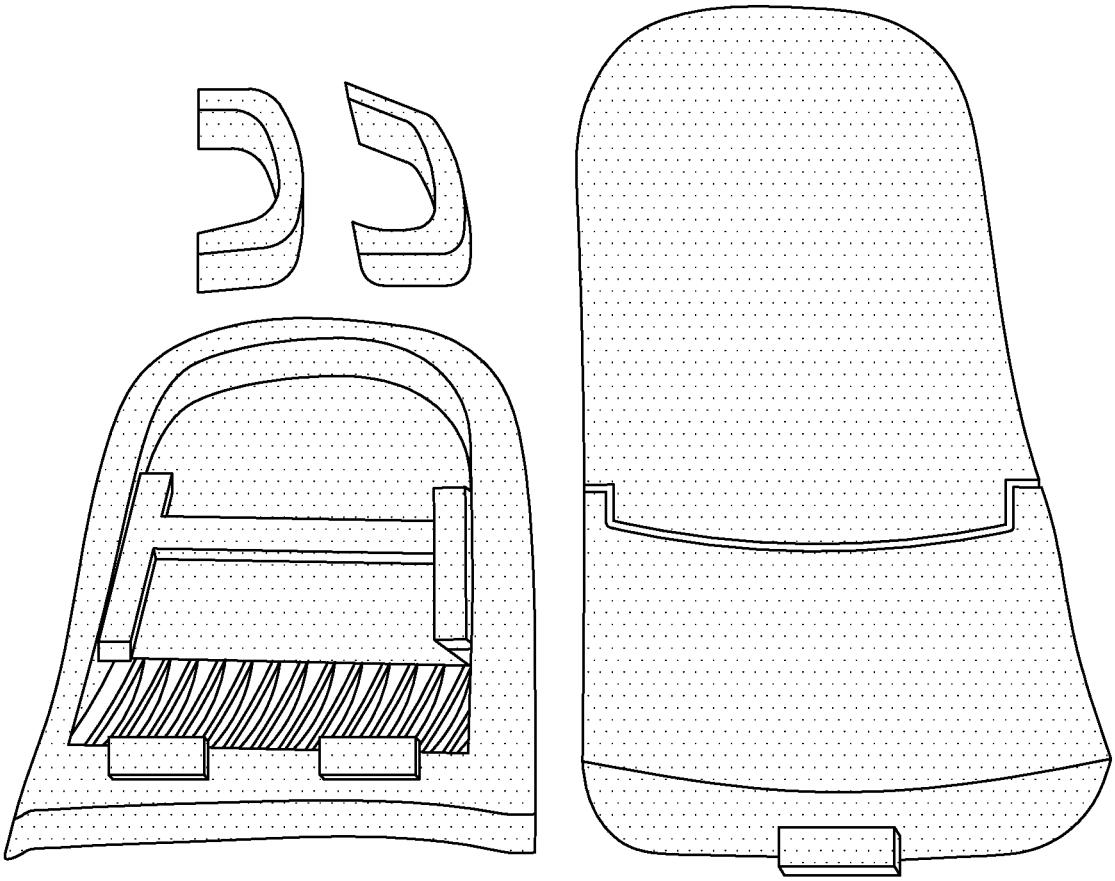
FIG. 4 is a top view of a partially disassembled modular chair of the invention showing some of the various components separated from each other to facilitate either transportation or storage.

With reference to FIG. 4 of the drawings, the modular chair 10 can be folded in the middle and carried easily, unlike many other forms of furniture in this category. Such options are highly beneficial, since furniture of this type is usually long and often not very easy to move around, but the present invention allows for disassembly and storage in a compact manner which facilitates convenient handling. FIG. 4 shows the handles removed, the backrest detached, but the seating portion and the leg support still attached, although foldable. The three components may be separable form each other, or can fold more compactly relatively to each other, or both, and the user can select a mechanism for compacting depending upon the circumstances.

The modular chair 10 of the invention further comprises a support bracket 90 which releasably attaches to the backrest 26 at one end, and to the frame 80 of the seating area 12 at its other end. Multiple points of attachment of the support bracket 90 are possible, which allows the backrest 26 to be positioned at different reclining angles relative to the seating area 12. The support bracket 90 may be pivotally connected to the rear surface of the backrest 26 so that it can be folded up against or stack within the backrest 26 when not used, so that it is not in the way. See, for example, FIG. 4 of the drawings, which shows this feature.

The invention further comprises a leg support bracket 94 which attaches at its one end to the leg support 40, while the other end thereof will rest on the substrate or surface upon which the modular chair 10 is located. Once more, there may be multiple points of attachment for the leg support bracket 94 configured into the leg support 40 so that the leg support 40, which pivotally connects to the seating area 12, may be raised or lowered within certain parameters to meet the comfort needs of the user. The leg support bracket 94 may be constructed such that it is pivoted in a manner which allows it to be folded up against or within the leg support 40 so that it can be stored out of the way when not in use.

As mentioned above, the backrest 26 is pivotally connected to the seating area 12, while the leg support 40 is also pivotally connected to the seating area 12. Any suitable form of connection which provide sufficient strength but also allows easy to operate pivoting or rotating about the bases thereof, can be used. Thus, snaps, additional hardware, post in slot configurations, axles and axle channels, as well as other forms of construction may be used, all in accordance with the present invention, to achieve these purposes.

The modular chair 10 of the invention incorporates a number of benefits and conveniences. For example, the modular chair 10 is foldable, and at least some of the components thereof may be separated so as to be assembled and disassembled with each other in order to facilitate moving and storage. The backrest 26, when folded, overlaps the frame 80. This arrangement also provides more support when the backrest 26 is laid-back, so that the user can feel more stable and better supported within the chair. The back support can be adjusted into a plurality of positions, so that a comfortable angle of recline can be achieved by the user.

In one embodiment, the back support may have a hinge bar which acts as a load bearing member when rested against.

The modular chair 10 of the invention may be comprised of any suitable material, but a preferred material might comprise engineering grade UV resistant plastics, including the handles and feet. Moreover, the flat leg ends, or the feet, are preferably designed in such a way that the modular chair 10 can suitably be placed on a number of different surfaces, such as sand, concrete, pebbles or gravel, providing the necessary support and stability regardless of such surface.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

The invention claimed is:

1. A modular furniture seat assembly comprising:

a seating portion having a front end, a rear end, a pair of opposing side edges;

a back portion having a lower end, an upper end, and a pair of opposing side edges, wherein the lower end of the back portion is adjacent the rear end of the seating portion and is pivotable relative to the seating portion such that the back portion can be selectively and angularly positioned relative to the seating portion between a more reclining position and a more upright position;

an extender frame portion having a lower end, an upper end, and a pair of opposing side edges, wherein the lower end of the extender frame portion is adjacent to the rear end of the seating portion, wherein the back portion is at least partially supported on the extender frame portion when the back portion is in or near the more reclining position so that the back portion at least partially overlies the extender frame portion; and a pair of lateral support arm assemblies having an inner portion and an outer portion, each of the pair of lateral support arm assemblies having a first arm connectable to the seating portion and a second arm, and the extender frame connector component connects releasably to the second arm connector component, the lateral support arm assemblies further comprising at least one leg portion, the leg portion supporting the modular furniture seating when the modular furniture seat assembly is in an assembled condition.

2. A modular furniture seat assembly as claimed in claim 1 further comprising a pivot member for connecting the lower end of the back portion to rear end of the seating portion.

3. A modular furniture seat assembly as claimed in claim 2 wherein pivot member is a releasable pivot member.

4. A modular furniture seat assembly as claimed in claim 3 further comprising a support bracket positioned between the extender frame portion and the back portion to support the back portion, the support bracket being movable between a plurality of selected positions to support the back portion in an orientation and at an angle relative to the seating portion.

5. A modular furniture seat assembly as claimed in claim 4 wherein the support bracket is pivotally fixed at one end to the back portion so that it can be moved to a storage position against the back portion when not required for supporting the back portion.

6. A modular furniture seat assembly as claimed in claim 4 wherein the extender frame portion has a plurality of spaced lock members for receiving an end of the support bracket, such that the back portion is differently angled relative to the seating portion depending upon which one of the plurality of spaced lock members receives the end of the support bracket.

7. A modular furniture seat assembly as claimed in claim 1 further comprising a foot portion having a front end and a remote end, the front end of the foot portion connecting to the front end of the seating portion in a releasable manner and such that the foot portion can be rotated relative to the seating portion to selectively adjust the orientation thereof relative to the seating portion.

8. A modular furniture seat assembly as claimed in claim 7 further comprising a foot portion support leg foldable between a stowaway position against the foot portion and an extended position wherein the foot portion support leg provides support to the foot portion at or near the remote end of the foot portion.

9. A modular furniture seat assembly as claimed in claim 7 wherein the foot portion support is adjustable so as to hold the foot portion in a selected position.

10. A modular furniture seat assembly as claimed in claim 1 wherein the seating portion, back portion and lateral support arm assemblies may be disassembled and compactly placed in a customized container for storage and transportation.

11. A modular furniture seat assembly as claimed in claim 1 wherein the leg portions of the lateral support arm assembly have leg ends which are configured to keep the furniture seat assembly stable on different types and smoothness surfaces.

12. A modular furniture seat assembly as claimed in claim 1 wherein each lateral arm support comprises a generally linear front portion having a leg end and an upper end, and a curved rear portion having a leg end and an upper end, the upper ends of the front portion and the curved portion respectively being attached to each other.

13. A modular furniture seat assembly as claimed in claim 1 wherein the support arm assembly further comprises a second arm connector component, and the seating portion further comprises an additional seating connector component connectable to the second arm connector component.

14. A modular furniture seat assembly as claimed in claim 13 wherein the pair of lateral support arm assemblies have an inner surface and an outer surface wherein each of the pair of lateral support arm assemblies has the first arm connector component on the inner surface thereof which is releasably connectable to the seating connector component, the lateral support arm assemblies comprising the armrest portion and the leg portion, the leg portion supporting the modular furniture seating item when the modular furniture seat assembly is in an assembled condition.

* * * * *